US008763580B2

(12) United States Patent
Belau et al.

(10) Patent No.: US 8,763,580 B2
(45) Date of Patent: Jul. 1, 2014

(54) METHOD OF STARTING AN INTERNAL COMBUSTION ENGINE, DEVICE AND CONTROLLER

(75) Inventors: Horst Belau, Langquaid (DE); Michael Jung, Pielenhofen (DE)

(73) Assignee: Continental Automotive GmbH, Hannover (DE)

( * ) Notice: Subject to any disclaimer, the term of this patent is extended or adjusted under 35 U.S.C. 154(b) by 611 days.

(21) Appl. No.: 12/812,070

(22) PCT Filed: Oct. 27, 2008

(86) PCT No.: PCT/EP2008/064527

§ 371 (c)(1),
(2), (4) Date: Jul. 8, 2010

(87) PCT Pub. No.: WO2009/086957

PCT Pub. Date: Jul. 16, 2009

(65) Prior Publication Data

US 2010/0275872 A1 Nov. 4, 2010

(30) Foreign Application Priority Data

Jan. 8, 2008 (DE) ..... 10 2008 003 540

(51) Int. Cl.
*F02N 11/00* (2006.01)
*F02D 41/06* (2006.01)
*F02P 5/15* (2006.01)

(52) U.S. Cl.
USPC ..... 123/179.4; 123/179.3

(58) Field of Classification Search
USPC ..... 123/179.16, 179.3, 4, 5, 18, 16, 295, 123/305, 406.29, 179.4
See application file for complete search history.

(56) References Cited

U.S. PATENT DOCUMENTS

| | | | | |
|---|---|---|---|---|
| 6,098,585 | A * | 8/2000 | Brehob et al. | 123/179.4 |
| 6,588,397 | B1 | 7/2003 | Sieber | 123/295 |
| 6,799,547 | B2 | 10/2004 | Sieber | 123/179.5 |
| 7,191,746 | B2 * | 3/2007 | Nakamura | 123/179.3 |
| 2007/0062470 | A1 * | 3/2007 | Ashizawa et al. | 123/90.15 |
| 2007/0062476 | A1 | 3/2007 | Ota et al. | 123/179.4 |
| 2007/0131188 | A1 * | 6/2007 | Hokuto | 123/179.4 |

FOREIGN PATENT DOCUMENTS

| | | | |
|---|---|---|---|
| DE | 27212 | 5/1884 | F02N 17/00 |
| DE | 201157 | 8/1908 | F02N 15/00 |
| DE | 19955857 | 6/2001 | F02N 17/00 |

(Continued)

OTHER PUBLICATIONS

International Search Report and Written Opinion with English Translation for Application No. PCT/EP2008/064527 (22 pages), Mar. 31, 2009.

(Continued)

*Primary Examiner* — Hieu T Vo
*Assistant Examiner* — Arnold Castro
(74) *Attorney, Agent, or Firm* — King & Spalding L.L.P.

(57) ABSTRACT

In a method for starting an internal combustion engine having at least one cylinder, an inlet and an outlet valve, and having a piston interacting with a crankshaft, and the crankshaft moving in a predetermined rotational direction during normal operation of the internal combustion engine, the piston is located in an initial position, the piston is moved into a defined starting position against a normal rotational direction of the crankshaft by means of a drive, fuel is injected, and the fuel is ignited.

18 Claims, 3 Drawing Sheets

(56) References Cited

FOREIGN PATENT DOCUMENTS

| | | | |
|---|---|---|---|
| DE | 10020325 | 11/2001 | ..... F02N 17/00 |
| DE | 102005049842 | 4/2006 | ..... F02N 17/00 |
| EP | 1375908 | 1/2004 | ..... F02N 11/08 |
| EP | 1486667 | 12/2004 | ..... F02N 17/00 |
| EP | 1591658 | 11/2005 | ..... F02N 11/08 |

OTHER PUBLICATIONS

German Office Action for Application No. 10 2008 003 540.8 (2 pages), Sep. 2, 2008.

* cited by examiner

METHOD OF STARTING AN INTERNAL COMBUSTION ENGINE, DEVICE AND CONTROLLER

CROSS-REFERENCE TO RELATED APPLICATIONS

This application is a U.S. National Stage Application of International Application No. PCT/EP2008/064527 filed Oct. 27, 2008, which designates the United States of America, and claims priority to German Application No. 10 2008 003 540.8 filed Jan. 8, 2008, the contents of which are hereby incorporated by reference in their entirety.

TECHNICAL FIELD

The invention relates to a method of starting an internal combustion engine according to claim 1, a device for starting an internal combustion engine.

BACKGROUND

It is known to start an internal combustion engine without the use of a starter by injecting fuel into a cylinder, the piston of which is in a power phase, and by igniting the injected fuel.

The igniting of an internal combustion engine without the use of a starter is necessary in particular to set an engine, which is being operated with many stop phases, running again without high electrical energy. For example, in the case of fuel-economy engines, the engines are stopped during stop phases, for example at traffic lights or upon other interruptions to travel, and the internal combustion engine is restarted by actuation, for example of the clutch.

From DE 199 55 857 A1 and from DE 100 20 325 A1 corresponding methods of starting an internal combustion engine are known. Here an internal combustion engine, in particular for a motor vehicle, is described, which is provided with pistons that are movable [in] a cylinder and act upon a crankshaft. During operation of the internal combustion engine the piston runs through an induction phase, a compression phase, a power phase and an exhaust phase. A controller is further provided, by means of which fuel is injected in a first operating mode during a compression phase or in a second operating mode during an induction phase directly into a combustion chamber delimited by the cylinder and the piston. The controller is designed in such a way that in order to start the internal combustion engine in the stationary state of the crankshaft fuel is injected into the cylinder, the piston of which is in the compression phase, and ignited so that the crankshaft moves backwards. In this case, it may be disadvantageous that a cylinder can no longer be used for compression and ignition because combustion residues of a not yet exhausted combustion pre-gas are present, with the result that a combustible mixture does not exist.

It could moreover be disadvantageous if the engine is stationary for an extended period because then the pressure in the compression cylinder has dropped to such an extent that reliable ignition cannot occur. As with direct starting, the starting capability depends upon the filling volume, the state of the piston and also upon the length of time between stop and start. The pressure in the cylinder to be ignited lasts for a short time only. After a longer pause between stop and start the pressure adjusts itself to the ambient pressure. The residual volume may then have a lower oxygen content. A further drawback is that parasitic residual gases further impair the ignitability.

SUMMARY

According to various embodiments, an improved method and an improved device for starting an internal combustion engine with a low consumption of electrical energy can be provided.

According to an embodiment, in a method of starting an internal combustion engine having at least one cylinder, an inlet- and an exhaust valve and having a piston that interacts with a crankshaft and moves the crankshaft during normal operation of the internal combustion engine in a defined direction of rotation, wherein the piston is situated in a first or initial position, the piston is moved with the aid of a drive counter to the normal direction of rotation of the crankshaft into a defined start position, fuel is injected into the cylinder and the fuel is ignited.

According to a further embodiment, upon a cutting-out of the internal combustion engine an ignition provided for the cylinder is not carried out. According to a further embodiment, the first or initial position may lie in the power stroke of the piston, and the piston may be moved back in the direction of the top dead centre. According to a further embodiment, the piston is not moved back over the top dead centre. According to a further embodiment, before reaching the start position fuel may be injected into the cylinder and then the fuel may be ignited. According to a further embodiment, fuel can be injected into the first cylinder before reaching the start point and the fuel can be ignited at the start point. According to a further embodiment, the internal combustion engine may comprise at least a second cylinder having a second inlet valve, having a second exhaust valve and having a second piston that interacts with the crankshaft, wherein, as the first piston moves into the start position, the second piston is moved into a third position, during which the inlet valve of the second cylinder is opened. According to a further embodiment, the movement of the first piston upon cutting-out of the internal combustion engine can be braked in movement and may come to a standstill in a defined position. According to a further embodiment, the first piston can be moved into a region after the top dead centre but without opening of the exhaust valve. According to a further embodiment, the first piston can be moved from the first or initial position further in the normal direction of rotation of the crankshaft until the exhaust valve of the first cylinder opens, that the first piston is then moved counter to the normal direction of rotation of the crankshaft into the start position.

According to another embodiment, a device for starting an internal combustion engine may comprise a controller and a drive that is connected to a crankshaft of the internal combustion engine, wherein the controller is designed to control the drive in accordance with a method as described above.

According to yet another embodiment, a controller can be designed to carry out a method as described above.

BRIEF DESCRIPTION OF THE DRAWINGS

There now follows a detailed description of the invention with reference to the figures. These show in FIG. 1 a diagrammatic representation of an internal combustion having four cylinders, FIG. 2 a diagrammatic representation of one of the cylinders and a controller, FIG. 3 a first program run, FIG. 4 a diagrammatic representation of part of the power strokes of the first and third cylinder, and FIG. 5 a second program run.

DETAILED DESCRIPTION

An advantage of the method according to various embodiments is that the piston of the cylinder to be ignited is moved into a defined start position. For this purpose a drive is provided, which is workingly connected to the piston.

In a further form of implementation, upon cutting-out of the internal combustion engine an ignition provided for the cylinder is not carried out. Thus, no exhaust gases are contained in the cylinder. Furthermore, the oxygen content of the filling of the cylinder is higher than after an ignition.

In a further form of implementation the piston is moved from a power stroke back in the direction of the top dead centre. In this case, the piston is preferably not moved back over the top dead centre. This saves current because a high compression energy to a point over the dead centre is not necessary. The lower energy consumption of the starter motor has the added result that a starting-voltage dip as a result of the starter is lower. This allows the electronic equipment in the motor vehicle to be of a simpler design.

In a further form of implementation the first piston of the first cylinder is coupled to a second piston of a second cylinder and the first piston is moved back until an inlet valve of the second piston opens and lets ambient air into the second piston. This ensures that the second piston is filled with fresh air, i.e. with air containing unburnt oxygen.

In a further form of implementation, after cutting-out of the internal combustion engine the movement of the first piston is braked and hence the first piston is brought to a halt in a desired starting position. In this way the starting position of the first piston may be selected in a defined manner.

In a further form of implementation the first piston in the first cylinder is moved back in the direction of the top dead centre, without however opening the exhaust valve of the first cylinder. This ensures that the gas filling in the first cylinder is compressed.

In a further form of implementation, upon cutting-out of the internal combustion engine the first piston is braked into a starting position that lies in the power stroke or in the exhaust stroke.

In a further form of implementation, the first piston, if it is situated at a standstill in the power stroke, is moved further in the direction of rotation of the engine until the exhaust valve opens. The first piston is then moved counter to the direction of rotation of the engine into the start position. The effect thereby achieved is that the first cylinder is filled with gas through an exhaust channel.

Figure 1:
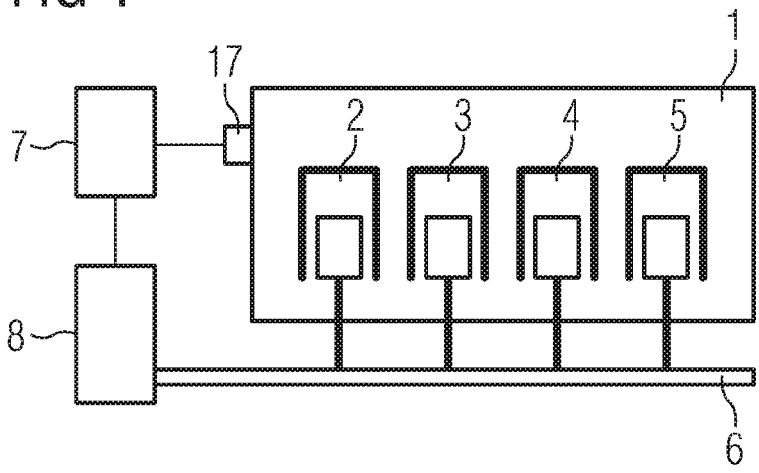

FIG. 1 shows in a diagrammatic representation of an internal combustion engine 1 having four cylinders 2, 3, 4, 5, which are workingly connected to a crankshaft 6. The crankshaft 6 is connected by a non-illustrated clutch and by a non-illustrated transmission to a non-illustrated drive train, for example of a motor vehicle. FIG. 1 shows an internal combustion engine that operates according to a four-stroke principle. To control the gas exchange a camshaft rotating at twice the engine speed is used, which is driven by the crankshaft. The camshaft opens the gas exchange valves, which are designed separately to push out the waste gases and take in the fresh gases, counter to the action of the valve springs. Shortly before the bottom dead centre the exhaust valve opens and, given a supercritical pressure ratio, during this preliminary exhaust ca. 50% of the combustion gases leave the combustion chamber. During the exhaust stroke the upward-moving piston ensures an almost complete removal of the combustion gases from the combustion chamber. Shortly before the top dead centre of the piston the inlet valve opens while the exhaust valve is still open. To distinguish it from the ignition TDC, at which combustion occurs, this position of the crankshaft is known as the gas exchange TDC because in this region the otherwise strictly separate intake- and exhaust processes overlap. Shortly before the gas exchange TDC the exhaust valve closes and, while the inlet valve is open, the downward-moving piston may take in fresh air. This second stroke of the gas exchange, the induction stroke, lasts until shortly after the bottom dead centre. During the following upward movement of the piston a compression process is carried out. Then, at the ignition TDC the igniting of the injected fuel occurs. During the following power stroke the combustion occurs and the piston is moved back down. Instead of a camshaft, an electric drive may be provided for opening and closing the inlet- and exhaust valves. A piston therefore executes the induction stroke, the compression stroke, the power stroke and the exhaust stroke, i.e. 4 strokes. In the case of a four-cylinder engine, for example the first and second cylinder are in phase and the third and fourth cylinder are out of phase by one stroke.

In FIG. 1 a controller 7 and a drive 8, in particular an electric motor and/or a motor/generator unit are further provided. The drive 8 is connected to the crankshaft 6. The four cylinders 2, 3, 4, 5 are substantially identical in construction and are now described with reference to the first cylinder 2.

Figure 2:
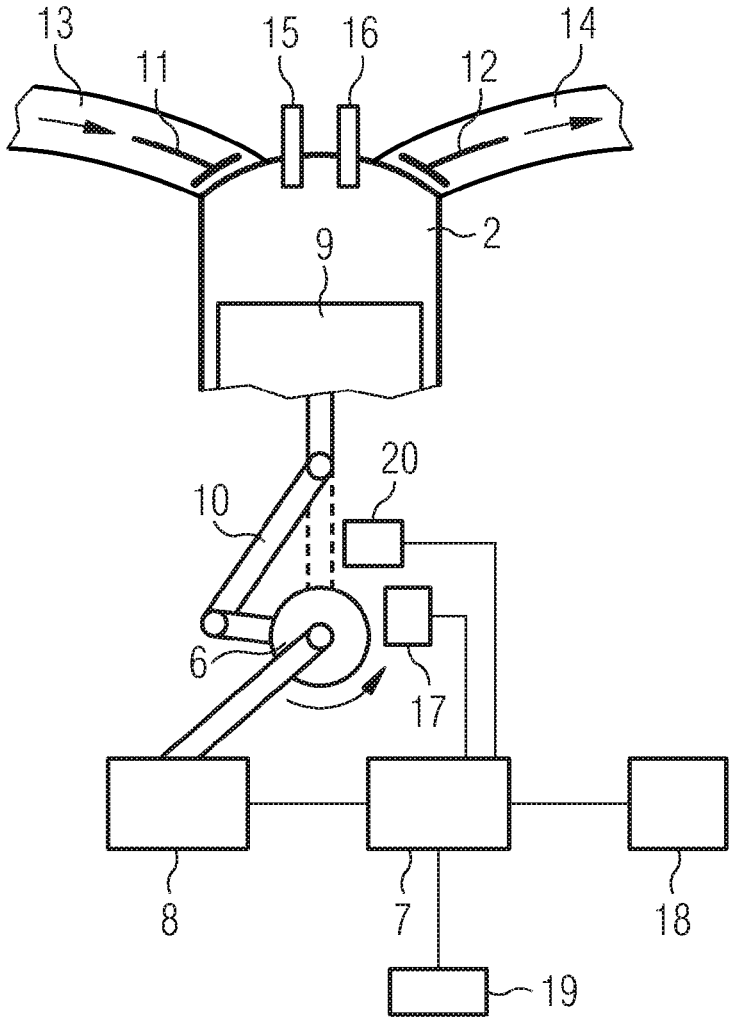

FIG. 2 shows the first cylinder 2 having a first piston 9, which is connected by a connecting rod 10 to the crankshaft 6. On the first cylinder 2 an inlet valve 11 and an exhaust valve 12 are provided. The inlet valve 11 and the exhaust valve 12 are actuated by a non-illustrated camshaft. The inlet valve 11 is disposed in an intake channel, through which fresh air is sucked into the first cylinder 2. The exhaust valve 12 is disposed in an exhaust channel, through which burnt exhaust gases may be discharged into the exhaust channel 14. An ignition device 15 is further provided, which projects into the first cylinder 2 and by means of which a fuel-air mixture may be ignited. An injection valve 16 is moreover provided, which injects fuel into the first cylinder 2.

Further represented is the drive 8, which is connected to the controller 7. By means of the drive 8 the position of the pistons may be adjusted via the crankshaft. The controller 7 is connected to a plurality of sensors 17, which acquire various operating parameters of the internal combustion engine and/or of the motor vehicle, in particular a crankshaft angle of the crankshaft 6. In the data/program memory 18 values and programs are filed, which the controller 7 uses to control the internal combustion engine 1. For example, in the data/program memory 18 values, at which the inlet- and/or exhaust valve 11, 12 are opened and/or closed, are filed. Further filed in the data/program memory 18 are data that determine the instant, at which an ignition by means of the ignition device 15 occurs in the cylinder. The controller 7 is moreover connected to a start/stop switch 19. The start/stop switch 19 is used to communicate to the controller 7 whether the internal combustion engine is to be started or cut out. The start/stop switch may be designed in the form of an ignition switch or an on/off switch.

Figure 3:
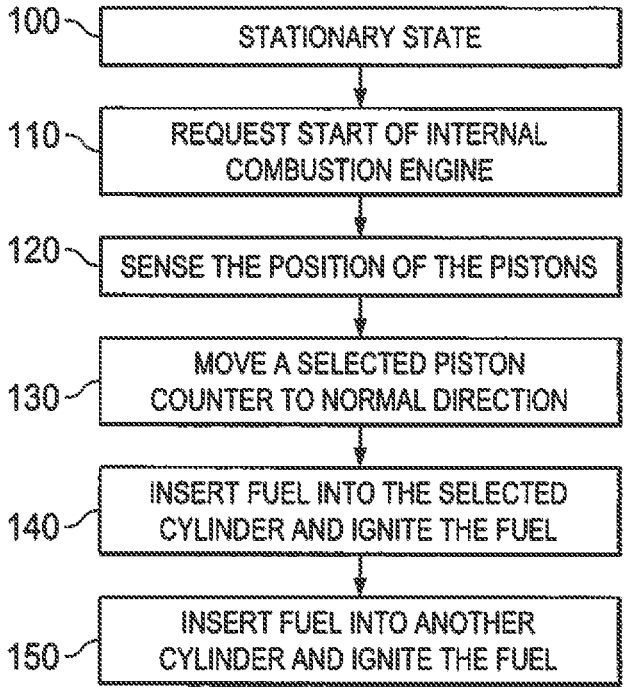

FIG. 3 shows a form of implementation for carrying out a method of starting an internal combustion engine 1. In this case, the internal combustion engine 1 in a first program point 100 is in a stationary state, i.e. no injection and no ignition is being carried out and the pistons of the cylinders are not moving. Then, in program point 110 the information that the internal combustion engine 1 is to be started is passed to the controller 7. This may be realized for example by means of the start/stop switch 19 or by actuation of another switch, for example by detection of the actuation of the clutch pedal. The controller 7, which acquires the position of the individual pistons of the cylinders by means of the sensors 17, selects the cylinder that is situated in the power stroke. This is carried out in program point 120.

In the following program point 130 the controller 7 controls the drive 8 in such a way that the selected cylinder is moved counter to the direction of motion during normal operation of the internal combustion engine back in the direction of the top dead centre. In this case, the gas in the first cylinder 2 is compressed.

Figure 4:
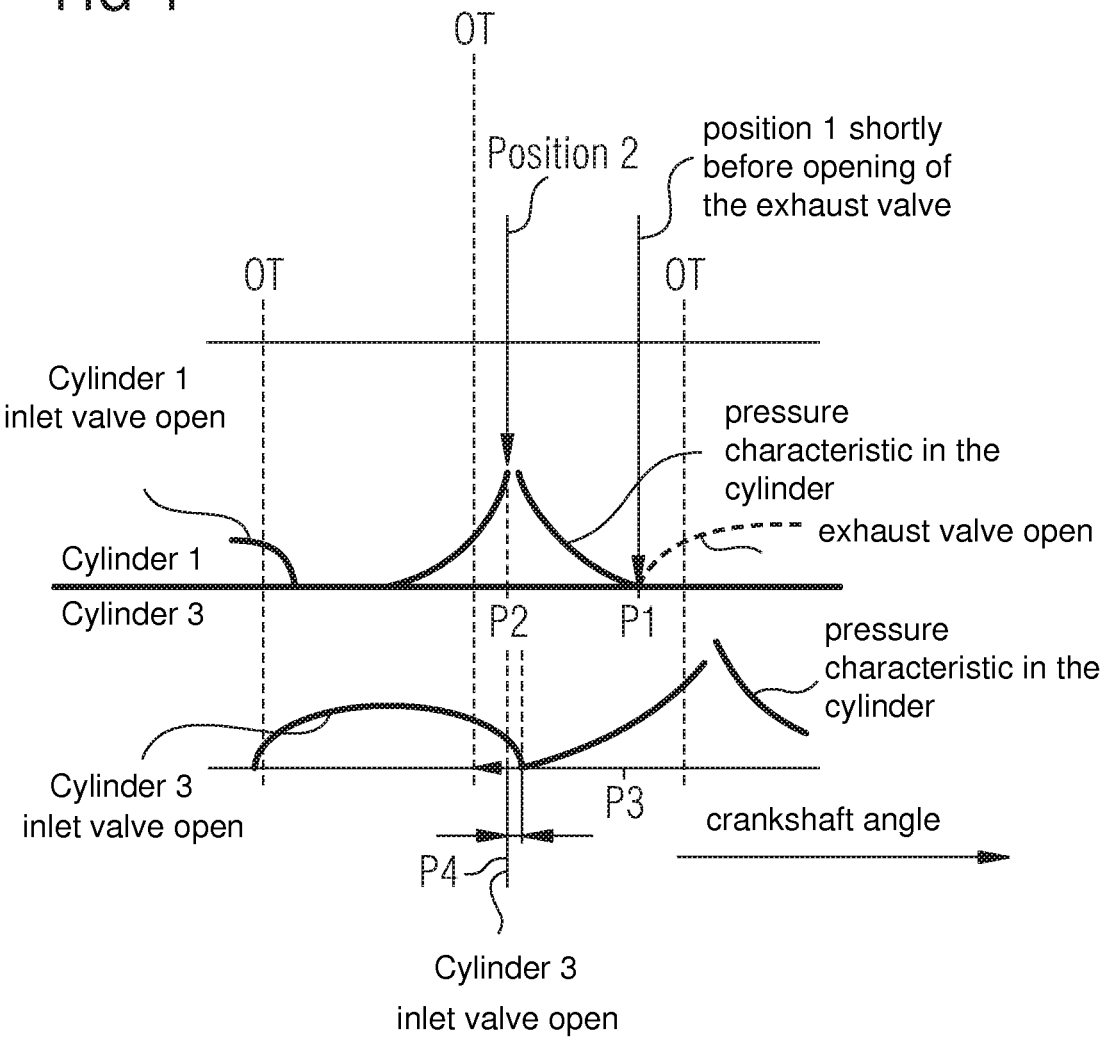

This situation is represented in FIG. 4. In the inoperative state of the internal combustion engine the first cylinder is situated in a first position P1 shortly before opening of the exhaust valve. The first piston is then moved by the drive 8 back in the direction of a second position P2 until shortly before the top dead centre. Assuming that the internal combustion engine 1 has a plurality of cylinders, in particular four cylinders 2, 3, 4, 5, then for example the third cylinder is situated in the compression stroke in a third position P3 in the inoperative state of the internal combustion engine. As the first piston is moved back into the second position P2, a third piston of the third cylinder is moved back in the fourth position P4. In the fourth position P4 the inlet valve of the third cylinder is open, so that fresh air may flow into the third cylinder. Through the use of the drive 8 the instant and the position of the pistons during backward motion may be selected freely within specific limits. For example, the first piston of the first cylinder is reversed in the direction of the top dead centre but not beyond the top dead centre. In the second position P2 of the first piston, in a program point 140 fuel is injected into the first cylinder and then the fuel is ignited by means of the ignition device 15.

As a result of the combustion in the first cylinder 1 and the kinetic energy thus produced, the first piston is moved in the normal direction of motion of the internal combustion engine, wherein the air in the third cylinder is compressed. Upon reaching an optimum instant in the region of the top dead centre, in a following program point 150 fuel is injected into the third cylinder and the fuel-gas mixture is ignited. In this way it is possible for the third cylinder, directly after the first cylinder, also to execute a full power stroke. By means of these two power strokes it is possible to start the engine, without starting of the internal combustion engine with the aid of a starter being required. Compared to a starter the drive 8 may be of a markedly weaker design, as the drive has to reverse a piston of a cylinder only in the direction of the top dead centre, without having to compress air with the piston beyond the top dead centre. Thus, no compression over the top dead centre is required, nor is there any need to have to reach a minimum engine speed or carry out a plurality of ignition attempts. The drive 8 may therefore be of a markedly lighter and more economical construction than a normal starter-generator.

The first point P1 is situated for example at a crankshaft angle of 1° to 10° before opening of the exhaust valve. The second position P2 is situated for example at a crankshaft angle of 1° to 10° after the top dead centre for the ignition.

Figure 5:
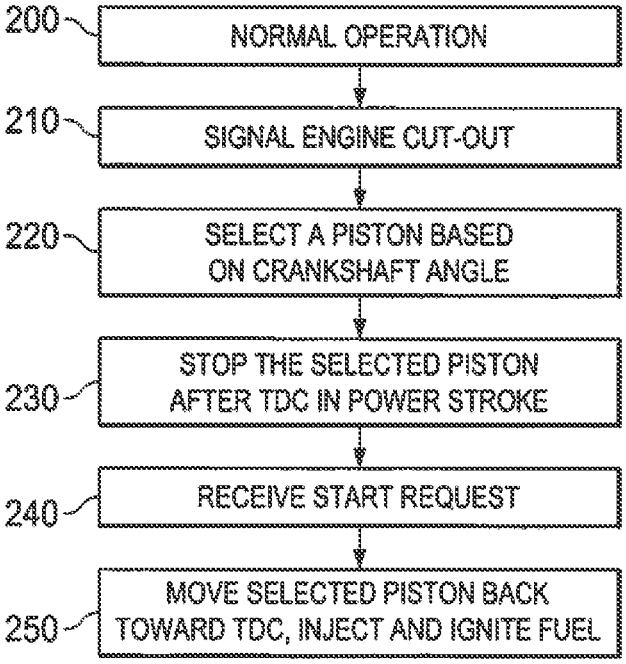

FIG. 5 shows a further variant of a program run for carrying out a method of starting an internal combustion engine. In this case, the internal combustion engine in a program point 200 is operating normally, i.e. fuel is being injected into the cylinders and ignited. In a following program point 210 the controller 7 receives the information that the internal combustion engine 1 is to be cut out. The controller 7, which acquires the positions of the individual pistons of the cylinders, selects a suitable piston. For this purpose the controller 7 uses the information of a crankshaft sensor and the information of a camshaft sensor for the corresponding pistons. This is carried out in program point 220. In a following program point 230 the controller 7 for example with the aid of the drive 8 brakes the selected piston, in the present example the first piston 9 of the first cylinder 2, in such a way that the first piston 9 after the top dead centre stops in the power stroke, i.e. in the first position P1. The first position P1 is preferably selected in such a way that the first cylinder 2 has as large an air filling as possible, i.e. that the first piston 1 is situated in a position just before opening of the exhaust valve of the first cylinder 2. In this case, the power stroke is no longer executed, i.e. preferably no more fuel is injected and no ignition occurs.

The internal combustion engine then remains in this position until a start request occurs. The start request occurs in program point 240. Then, in program point 250 the first piston 9 is moved counter to the normal engine running direction from the first position P1 back in the direction of the top dead centre OT. In this case, both the inlet valve and the exhaust valve of the first cylinder are closed. Before reaching the second position P2, which represents the end value of the reversed piston with maximally compressed air, fuel is injected. By means of the further compression stroke a swirling of the air-fuel mixture is achieved. On reaching the second position P2 the air-fuel mixture is ignited. The second position P2, as in the above example, is after the top dead centre OT, since energy to overcome the top dead centre is to be saved. The engine is moreover to start up in the direction of rotation. The fuel is injected for example at a crankshaft angle of 10° before reaching the second position P2.

Depending on the selected form of implementation, the second position P2 may be selected in such a way that the inlet valve of a further cylinder, in the present example the third cylinder, is opened and the third cylinder is supplied with fresh air. Depending on the selected form of implementation, the braking of the internal combustion engine may be carried out with the aid of a starter-generator for energy recovery, for example to recover electrical energy.

In a further form of implementation, during starting the piston of the selected cylinder that is ignited first is moved further by the drive 8 initially in the normal direction of motion until fresh air flows through the exhaust channel 14 into the selected cylinder. Only then is the piston of the selected cylinder moved counter to the direction of rotation of the engine back in the direction of the top dead centre, in the manner described above. As a rule, all of the pistons are connected to the crankshaft, so that all of the pistons are simultaneously moved.

In a further form of implementation, moreover, the piston of the selected cylinder during braking is braked in such a way that the exhaust valve of the selected cylinder is already open. Furthermore, in a further form of implementation the controller 7 may select a cylinder, the exhaust valve of which shortly after the power stroke is just open.

In a further form of implementation, an eddy-current brake 20 is used to brake the engine in order to recover electrical energy, which is fed into a battery.

What is claimed is:

1. A device for starting an internal combustion engine including at least two pistons each having an associated inlet valve and an exhaust valve, the device comprising:

a controller; and a drive that is connected to a crankshaft of the internal combustion engine, wherein the controller is configured to:

control the drive such that the drive moves the first piston counter to the normal direction of rotation of the crankshaft into a defined start position without opening the associated inlet valve or the associated exhaust valve and compresses the contents of the first piston, once the first piston is disposed in the defined start position, without opening the inlet valve and the exhaust valve, activate fuel injection into the cylinder, and trigger an ignition of the fuel, move the second piston into a third position while the first piston moves into the defined start position and open the inlet valve of the second cylinder during that movement.

2. A method of starting an internal combustion engine having at least a first cylinder and a second cylinder, each cylinder comprising an inlet- and an exhaust valve and a respective piston that interacts with a crankshaft and moves the crankshaft during normal operation of the internal combustion engine in a defined direction of rotation, wherein the first piston is situated in an initial position, the method comprising:

moving the first piston with the aid of a drive counter to the normal direction of rotation of the crankshaft into a defined start position and compressing the contents of the first piston without opening the inlet valve or the exhaust valve, injecting fuel into the at least one cylinder, after reaching the defined start position of the crankshaft, in which the inlet valve and the exhaust valve remain closed, a igniting the fuel, and moving the second piston into a third position as the first piston moves into the defined start position, during which movement the inlet valve of the second cylinder is opened.

3. The method according to claim 2, wherein an ignition provided for the cylinder is not carried out once a cutting out of the internal combustion engine occurs.

4. The method according to claim 2, wherein the initial position lies in the power stroke of the first piston, wherein the first piston is moved back in the direction of the top dead center.

5. The method according to claim 4, wherein the first piston is not moved back over the top dead center.

6. The method according to claim 2, further comprising injecting fuel into the first cylinder before it reaches the defined start position.

7. The method according to claim 2, wherein fuel is injected into the first cylinder before reaching the defined start point and the fuel is ignited at the defined start point.

8. The method according to claim 2, wherein the movement of the first piston upon cutting-out of the internal combustion engine is braked in movement and comes to a standstill in a defined position.

9. The method according to claim 8, wherein the first piston is moved into a region after the top dead center but without opening of the exhaust valve.

10. The method according to claim 2, further comprising:

moving the first piston from the initial position further in the normal direction of rotation of the crankshaft until the exhaust valve of the first cylinder opens, closing the first exhaust valve without moving the first piston, and then moving the first piston counter to the normal direction of rotation of the crankshaft into the defined start position without opening the exhaust valve during this movement, thereby compressing the contents of the first piston without opening the inlet valve or the exhaust valve.

11. A controller, which is designed to carry out a method of starting an internal combustion engine having at least two cylinders, each comprising an inlet- and an exhaust valve and having a respective piston that interacts with a crankshaft and moves the crankshaft during normal operation of the internal combustion engine in a defined direction of rotation, wherein the piston of the first cylinder is situated in a first position, wherein the controller is operable:

to move the first piston with the aid of a drive counter to the normal direction of rotation of the crankshaft into a defined start position without opening the inlet valve or the exhaust valve, thereby compressing the contents of the first piston, to inject fuel into the at least one cylinder, to ignite the fuel after reaching the defined start position of the crankshaft, in which the inlet valve and the exhaust valve remain closed, to move the second piston into a third position as the first piston moves into the defined start position and opening the inlet valve of the second cylinder during this movement.

12. The controller according to claim 11, wherein the controller is operable to inject fuel into the first cylinder before reaching the defined start point and to ignite the fuel at the defined start point.

13. The controller according to claim 11, further being operable, upon a cutting-out of the internal combustion engine, to not carry out an ignition provided for the cylinder.

14. The controller according to claim 11, wherein the first position lies in the power stroke of the first piston, wherein the controller is operable to move the first piston back in the direction of the top dead center.

15. The controller according to claim 14, wherein the controller is operable to not move the first piston back over the top dead center.

16. The controller according to claim 11, wherein the controller is operable to inject fuel into the cylinder before the first piston reaches the defined start position.

17. The controller according to claim 11, wherein the controller is operable to brake the movement of the first piston upon cutting-out of the internal combustion engine wherein the first piston comes to a standstill in a defined position.

18. The controller according to claim 17, wherein the controller is operable to move the first piston into a region after the top dead center but without opening of the exhaust valve.

* * * * *